US008347759B2

(12) United States Patent
Tsai

(10) Patent No.: US 8,347,759 B2
(45) Date of Patent: Jan. 8, 2013

(54) WELL COATED WRENCH

(76) Inventor: Cheng-Chang Tsai, Taichung (TW)

( * ) Notice: Subject to any disclaimer, the term of this patent is extended or adjusted under 35 U.S.C. 154(b) by 316 days.

(21) Appl. No.: 12/823,061

(22) Filed: Jun. 24, 2010

(65) Prior Publication Data

US 2011/0314973 A1 Dec. 29, 2011

(51) Int. Cl.
*B25B 13/46* (2006.01)

(52) U.S. Cl. ..... 81/60; 81/900

(58) Field of Classification Search ..... 81/60, 900
See application file for complete search history.

(56) References Cited

U.S. PATENT DOCUMENTS

| | | | | |
|---|---|---|---|---|
| 2,978,353 | A * | 4/1961 | Meier | 428/564 |
| 2,985,957 | A * | 5/1961 | Freedman | 30/124 |
| 3,741,047 | A * | 6/1973 | Kanowsky | 81/124.3 |
| 5,435,030 | A * | 7/1995 | Phillips | 7/138 |
| 6,053,076 | A * | 4/2000 | Barnes | 81/60 |
| 6,260,448 | B1 * | 7/2001 | Chaconas | 81/63 |
| 6,435,062 | B1 * | 8/2002 | McCann | 81/63 |
| 6,955,104 | B2 * | 10/2005 | Hu | 81/63.2 |
| 7,234,377 | B2 * | 6/2007 | Wolfson | 81/415 |
| 7,261,128 | B1 * | 8/2007 | Rivera | 140/122 |
| 7,584,686 | B2 * | 9/2009 | Tsai | 81/60 |
| 2004/0055423 | A1 * | 3/2004 | Hu | 81/60 |
| 2005/0022631 | A1 * | 2/2005 | Brazil | 81/119 |

* cited by examiner

*Primary Examiner* — Thomas B Will
*Assistant Examiner* — Mai Nguyen

(57) ABSTRACT

A well coated wrench includes a metal element, a one-way mechanism and an isolative coating. The metal element includes a tunnel defined therein. The one-way mechanism is substantially located in the tunnel. The one-way mechanism includes a tongue located outside the tunnel and a button located outside the tunnel. The isolative coating is provided on the metal element. The isolative coating includes an external annular ridge located around the button.

1 Claim, 3 Drawing Sheets

WELL COATED WRENCH

BACKGROUND OF INVENTION

1. Field of Invention

The present invention relates to a wrench and, more particularly, to a well coated wrench.

2. Related Prior Art

A wrench is generally made of metal for excellent rigidity. However, a user might get an electric shock while operating a metal wrench.

To avoid an electric shock, handles of some metal wrenches are coated with an isolative material such as rubber and plastics. However, a user might touch another portion of a metal wrench with a rubber or plastics-coated handle and get an electric shock.

To effectively avoid an electric shock, a well coated wrench is devised referring to FIG. 1. The well coated wrench is a one-way wrench. The one-way wrench includes a shank, a handle formed at an end of the shank, and a head formed at an opposite end of the shank. The shank, the handle and the head are made of metal in one piece. The shank, the handle and the head are coated with an isolative coating 1 of rubber or plastics. A one-way mechanism is substantially located in a tunnel 2 defined in the head. The one-way mechanism includes a tongue 3 located outside the head. The tongue 3 is also made of metal. The tongue 3 is not coated with any isolative material for precise size and excellent rigidity. A detent 5 is attached to the tongue 3. The detent 5 includes a first portion located in the tongue 3 and a second portion that is normally located outside the tongue 5. A button 4 is operable to release the detent 5 so that the second portion of the detent 5 can be moved into the tongue 3. The coating 1 includes an annular ridge 8 around the tunnel 2.

The well coated wrench is tested in an isolation-testing machine before it is made available on the market. The well coated wrench is buried in steel balls 6 after the tongue 3 is located in an isolative cup 7. It is determined whether there is any current between the steel balls 6 and the one-way mechanism. The annular ridge 8 is expected to prevent the steel balls 6 from entering the tunnel 2 and reaching the one-way mechanism. However, the steel balls 6 could get really close to the one-way mechanism when the button 4 is not pushed because an external diameter of the annular ridge 8 is smaller than an internal diameter of the button 4. Therefore, the well coated wrench could fail the test by mistake.

The present invention is therefore intended to obviate or at least alleviate the problems encountered in prior art.

SUMMARY OF INVENTION

It is the primary objective of the present invention to provide a well coated wrench that does not fail an isolation test by mistake.

To achieve the foregoing objective, the well coated wrench includes a metal element, a one-way mechanism and an isolative coating. The metal element includes a tunnel defined therein. The one-way mechanism is substantially located in the tunnel. The one-way mechanism includes a tongue located outside the tunnel and a button located outside the tunnel. The isolative coating is provided on the metal element. The isolative coating includes an external annular ridge located around the button.

Other objectives, advantages and features of the present invention will be apparent from the following description referring to the attached drawings.

BRIEF DESCRIPTION OF DRAWINGS

The present invention will be described via detailed illustration of the preferred embodiment versus the prior art referring to the drawings wherein.

DETAILED DESCRIPTION OF PREFERRED EMBODIMENT

Figure 1:
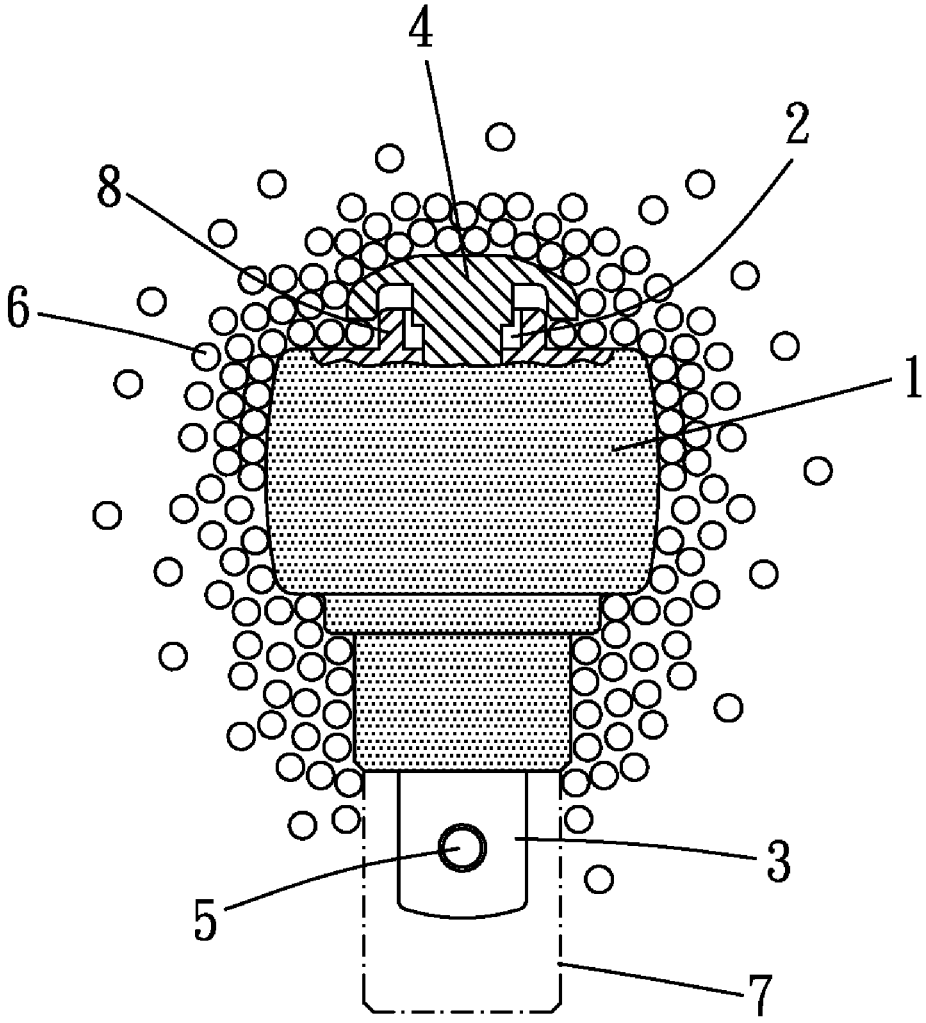
FIG. 1 PRIOR ART
FIG. 1 is a cross-sectional view of a conventional well coated wrench.
Figure 2:
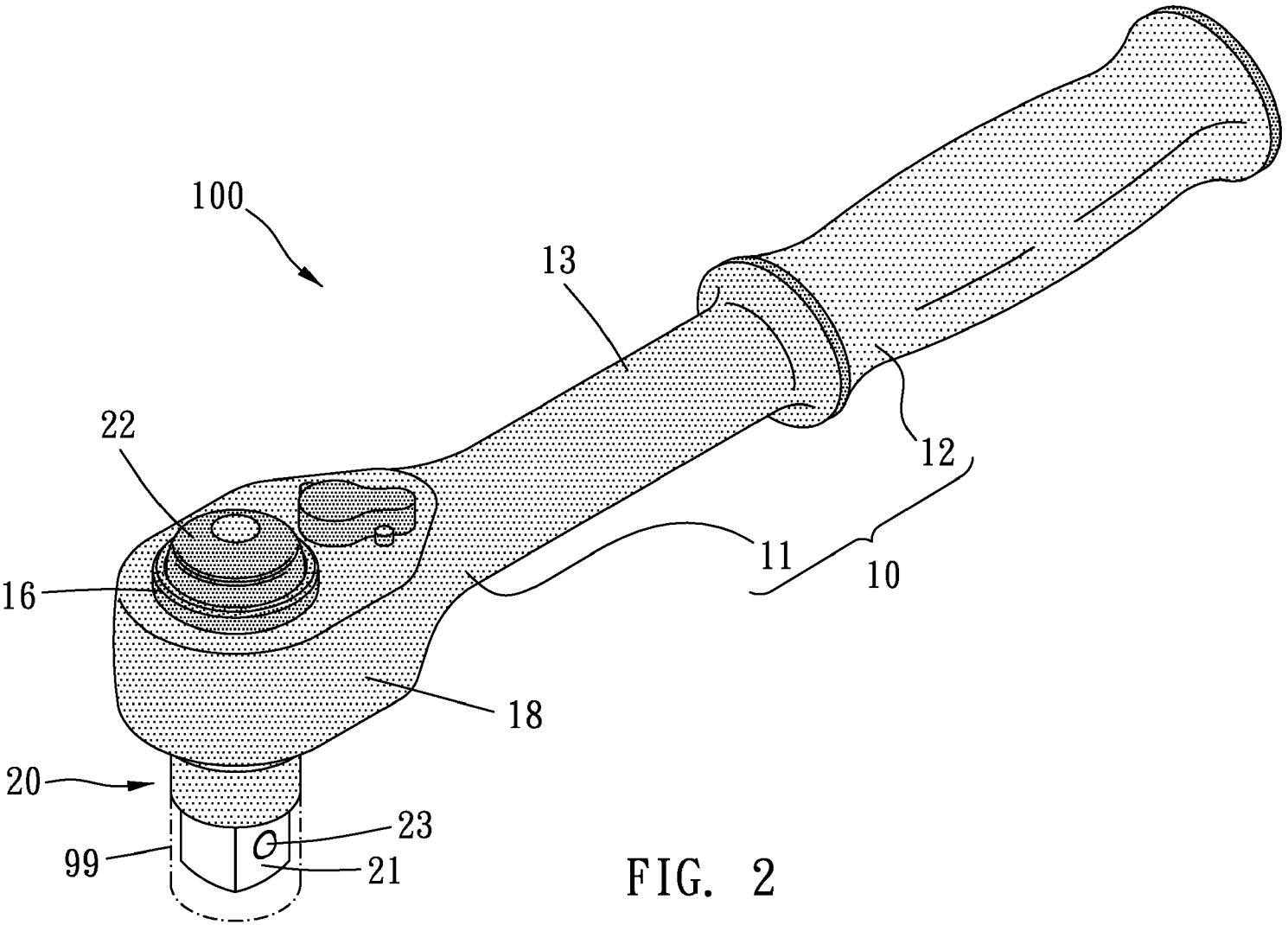
FIG. 2 is a perspective view of a well coated wrench according to the preferred embodiment of the present invention.
Figure 3:
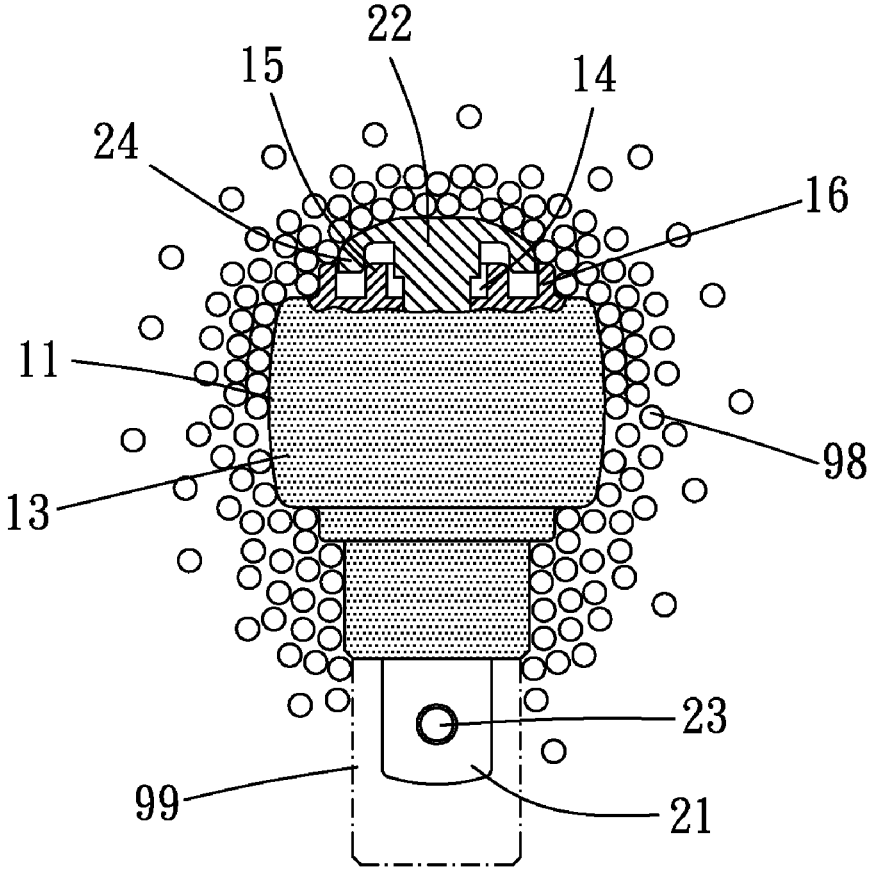
FIG. 3 is a cross-sectional view of the well coated wrench shown in FIG. 2.

Referring to FIGS. 2 and 3, there is shown a well coated wrench 100 according to the preferred embodiment of the present invention. The well coated wrench 100 includes a metal element 10, an isolative coating 13 and a one-way mechanism 20. The metal element 10 includes a shank 11, a handle 12 formed at an end of the shank 11, and a head 18 formed at an opposite end of the shank 11. The head 18 includes a tunnel 14 defined therein. The tunnel 14 extends throughout the head 18.

The one-way mechanism 20 is substantially located in the tunnel 14. The one-way mechanism 20 includes a tongue 21 located outside the tunnel 14. The tongue 21 is also made of metal. The tongue 21 is not coated with any isolative material such has rubber and plastics for precise size and excellent rigidity. A detent 23 is attached to the tongue 21. The detent 23 includes a first portion located in the tongue 21 and a second portion that is normally located outside the tongue 21.

A button 22 is operable to release the detent 23 so that the second portion of the detent 23 can be moved into the tongue 21. The button 22 is formed with an annular edge 24. The button 22 is made of an isolative material such as rubber and plastics.

In use, the button 22 is pushed to release the detent 23 so that the second portion of the detent 23 can be moved into the tongue 21. The tongue 21 is inserted in a socket. The button 22 is released so that the second portion of the detent 23 is located outside the tongue 21 again to retain the socket connected to the tongue 21. By pivoting the well coated wrench 100 to and fro, the socket is spun in a selected one of two opposite directions because of the one-way mechanism 20.

The isolative coating 13 is made of an isolative material such as rubber and plastics. The isolative coating 13 covers the metal element 10. That is, the isolative coating 13 covers the shank 11, the handle 12 and the head 18. The isolative coating 13 includes an internal annular ridge 15 around the tunnel 14 and an external annular ridge 16 around the internal annular ridge 15. An external diameter of the internal annular ridge 15 is marginally smaller than an internal diameter of the annular edge 24. An internal diameter of the external annular ridge 16 is marginally larger than an external diameter of the annular edge 24. The width of the gap between the annular ridges 15 and 16 is substantially identical to the thickness of the annular edge 24. Thus, the annular edge 24 is in contact with both of the annular ridges 15 and 16.

The well coated wrench 100 is tested in an isolation-testing machine before it is made available on the market. The well coated wrench 100 is buried in steel balls 98 after the tongue 21 is located in an isolative cup 99. It is determined whether there is any current between the steel balls 98 and the one-way mechanism 20. Both of the annular ridges 15 and 16 are in contact with the annular edge of the button 22. Thus, the annular ridges 15 and 16 affectively prevent the steel balls 98 from entering the tunnel 14 and reaching the one-way mechanism 20 when the button 22 is not pushed. Therefore, the well coated wrench would not fail the test by mistake.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A wrench including:

a metal head having a tunnel defined therein;

an isolative coating provided on the head and including an internal annular ridge disposed around the tunnel of the head and an external annular ridge around the internal annular ridge; and a one-way mechanism located substantially in the tunnel of the head and including a tongue located outside the tunnel of the head, a detent partly disposed in the tongue and an isolative button located outside the tunnel of the head; and wherein the button is formed with an annular edge and is pushable to control movement of the detent; when the button is pushed to release the detent, the button blocks substantially completely the tunnel of the head with the annular edge of the button fitted in a gap formed between the internal annular ridge and the external annular ridge; and when the button is released to retain the detent, the annular edge of the button remains in contact with both of the internal annular ridge and the external annular ridge.

* * * * *